US011255127B2

(12) United States Patent
Liu et al.

(10) Patent No.: US 11,255,127 B2
(45) Date of Patent: Feb. 22, 2022

(54) DRILL BIT WITH JOINT FUNCTION OF INDUCED UNLOADING AND ABRASIVE JET AND DRILLING METHOD THEREOF

(71) Applicant: CHINA UNIVERSITY OF PETROLEUM (EAST CHINA), Qingdao (CN)

(72) Inventors: Yongwang Liu, Qingdao (CN); Zhichuan Guan, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 17/056,751

(22) PCT Filed: Dec. 16, 2019

(86) PCT No.: PCT/CN2019/125584
§ 371 (c)(1),
(2) Date: Nov. 18, 2020

(87) PCT Pub. No.: WO2021/097972
PCT Pub. Date: May 27, 2021

(65) Prior Publication Data

US 2021/0246729 A1 Aug. 12, 2021

(30) Foreign Application Priority Data

Nov. 19, 2019 (CN) ..... 201911130628.2

(51) Int. Cl.
*E21B 10/04* (2006.01)
*E21B 10/43* (2006.01)
(Continued)

(52) U.S. Cl.
CPC ..... *E21B 7/18* (2013.01); *E21B 10/04* (2013.01); *E21B 10/43* (2013.01); *E21B 10/602* (2013.01)

(58) Field of Classification Search
CPC . E21B 10/04; E21B 7/18; E21B 10/42; E21B 10/43; E21B 10/602
See application file for complete search history.

(56) References Cited

U.S. PATENT DOCUMENTS 1,831,841 A * 11/1931 Brantly ..... E21B 10/003 175/404
1,836,638 A * 12/1931 Wright ..... E21B 10/04 175/333

(Continued)

FOREIGN PATENT DOCUMENTS

CN 102345445 A 2/2012
CN 103556947 A 2/2014

OTHER PUBLICATIONS

Office Action issued in corresponding Chinese Patent Application No. 201911130628.2, dated May 28, 2020, 11 pages.

(Continued)

*Primary Examiner* — Blake Michener
(74) *Attorney, Agent, or Firm* — Hauptman Ham, LLP

(57) ABSTRACT

A drill bit performs pilot rock-breaking using an outer annular drill bit and breaks a central rock pillar using a central drill bit mounted in the middle of the annular drill bit and located inside a drill bit body to induce unloading of a bottom hole stress. A method mixes rock debris produced by rock breaking of the central drill bit as abrasive with the drilling fluid flowing into the entire drill bit as abrasive jet liquid phase to form an abrasive jet. The method includes obtaining an annular borehole by braking, and breaking the rock pillar at the inner side of the annular borehole to induce unloading of the bottom hole stress, mixing the rock debris (Continued)

produced by breaking the rock pillar at the inner side of the annular borehole as abrasive with the drilling fluid entering the drill bit to form an abrasive jet.

1 Claim, 4 Drawing Sheets

(51) Int. Cl.
*E21B 10/60* (2006.01)
*E21B 7/18* (2006.01)

(56) References Cited

U.S. PATENT DOCUMENTS 2,022,101 A * 11/1935 Wright ..... E21B 10/04 175/293
2,034,073 A * 3/1936 Wright ..... E21B 10/04 175/333
2,708,103 A * 5/1955 Williams, Jr. ..... E21B 10/48 175/246
2,708,105 A * 5/1955 Williams, Jr. ..... E21B 10/62 175/400
2,731,236 A * 1/1956 Bruce ..... E21B 10/48 175/405.1
2,975,849 A * 3/1961 Stuart ..... E21B 10/04 175/333
3,055,443 A * 9/1962 Edwards ..... E21B 10/04 175/405.1
3,743,036 A * 7/1973 Feenstra ..... E21B 10/48 175/405.1
3,845,830 A * 11/1974 Fowler ..... E21B 10/04 175/404
3,861,478 A * 1/1975 Condolios ..... E21B 10/04 175/404
3,982,596 A * 9/1976 Vetter ..... E21B 10/04 175/426
5,016,718 A * 5/1991 Tandberg ..... E21B 10/04 175/333
5,176,212 A * 1/1993 Tandberg ..... E21B 10/04 175/333
5,497,841 A * 3/1996 Cox ..... B28D 1/041 175/213
5,568,838 A * 10/1996 Struthers ..... E21B 25/02 175/246
8,820,441 B2 * 9/2014 Shamburger ..... E21B 10/54 175/403
8,839,886 B2 * 9/2014 Jones ..... E21B 10/43 175/403
10,233,695 B2 * 3/2019 Guan ..... E21B 10/62
10,570,665 B2 * 2/2020 Maw ..... E21B 10/55
10,995,557 B2 * 5/2021 Grosz ..... E21B 10/20
2013/0228382 A1 * 9/2013 Sauvageau ..... E21B 10/60 175/331
2020/0149349 A1 * 5/2020 West ..... E21B 10/02
2020/0165876 A1 * 5/2020 Dunbar ..... E21B 10/20

OTHER PUBLICATIONS

First Search Report issued in corresponding Chinese Patent Application No. 201911130628.2, dated May 20, 2020, 4 pages.
Notice to Grant issued in corresponding Chinese Patent Application No. 201911130628 2, dated Aug. 28, 2020, 4 pages.
International Search Report issued in corresponding International Application No. PCT/CN2019/125584, dated Aug. 20, 2020; 9 pages.
Written Opinion issued in corresponding International Application No. PCT/CN2019/125584, dated Aug. 20, 2020; 7 pages.

* cited by examiner

DRILL BIT WITH JOINT FUNCTION OF INDUCED UNLOADING AND ABRASIVE JET AND DRILLING METHOD THEREOF

RELATED APPLICATIONS

The present application is a U.S. National Phase of International Application Number PCT/CN2019/125584, filed Dec. 16, 2019, and claims the priority of Chinese Application No. 201911130628.2, filed Nov. 19, 2019.

TECHNICAL FIELD

The present disclosure relates to the field of drilling engineering, and in particular to a drill bit for improving drilling rock breaking efficiency with joint function of induced unloading and abrasive jet and a drilling method thereof.

BACKGROUND

Releasing a bottom-hole stratum stress in advance may effectively improve a rock breaking efficiency of a drill bit to further increase a drilling speed. So far, scholars at home and abroad have proposed two methods of releasing the bottom-hole stress: one method of releasing the stratum stress based on hydraulic energy, represented by pulse cavitation jet speed-up technique, ultra-high-pressure pulse jet speed-up technique, abrasive jet speed-up technique, and the like; and the other method of releasing the stratum stress by changing a bottom-hole stress field by changing a shape of the bottom-hole, represented by reaming-while-drilling technique, two-level drill bit drilling technique, and the like. Releasing the stratum stress with hydraulic energy requires connection of a special tool above the drill bit, which not only changes the composition of a bottom-hole drill rig combination, but also consumes hydraulic energy of drilling fluid to a certain extent. Further, it cannot be applied to various well types, thus has limited application scenarios. The method of changing the bottom-hole stress field by changing the shape of the bottom-hole can achieve the effects of releasing the stratum stress and increasing the drilling speed by only optimizing the designing of the drill bit shape or the drill rig combination, thereby having a broad development prospect. However, the application effects of the drill bit and other tools for unloading the bottom-hole stress are still unsatisfactory by now.

The abrasive jet may fully exert the hydraulic energy at the drill bit to realize high efficient rock breaking. The abrasive jet may be generated above ground or underground. The above-ground generation requires special equipment, which will not only increase drilling costs but also erode drill strings. In contrast, the underground generation requires addition of an underground abrasive jet generator, which increases the complexity of the bottom-hole drill rig combination. So far, no technologies and relevant studies of generating the abrasive jet using the drill bit itself underground are found.

If a drill bit that can automatically release the bottom-hole stress to increase the drilling speed by using the induced unloading of the bottom-hole stress, and automatically generate the abrasive jet to achieve the purpose of improving the rock breaking efficiency with the aid of the abrasive jet is developed, the rock breaking efficiency will definitely be improved better. Therefore, a drill bit for improving a rock-breaking efficiency with joint function of bottom-hole induced unloading and abrasive jet and a drilling method thereof are urgently needed.

SUMMARY

To improve the drilling rock-breaking efficiency, the present disclosure provides a drill bit for improving a rock-breaking efficiency with joint function of bottom-hole induced unloading and abrasive jet and a drilling method thereof.

A drill bit with joint function of induced unloading and abrasive jet includes an annular drill bit and a central drill bit. The central drill bit is mounted in the center of the annular drill bit and recessed into a cavity of the annular drill bit, and the central drill bit and the annular drill bit cannot rotate relative to each other. The annular drill bit includes an upper drill rig connection joint and an annular drill bit body, a nozzle runner, a nozzle and a rock pillar through hole are disposed at a drill bit crown of the annular drill bit body, and a central drill bit rock-breaking body of the central drill bit corresponds to the rock pillar through hole. An ordinary drilling fluid runner and a central drill bit drilling fluid runner are disposed inside the central drill bit respectively, a rock debris transfer channel is disposed at an inner bottom end of the central drill bit and in communication with the central drill bit drilling fluid runner, an abrasive generation cavity is disposed at an outlet of the rock debris transfer channel which is at a lower part of the ordinary drilling fluid runner, and the abrasive generation cavity is in communication with the nozzle runner and the nozzle.

Further, an outer upper part of the upper drill rig connection joint is a drill rig connection buckle, an outer middle part of the upper drill rig connection joint is a cylindrical surface, and an outer bottom part of the upper drill rig connection joint is a joint welding groove; an inner upper part of the upper drill rig connection joint is a drilling fluid runner, an inner middle part of the upper drill rig connection joint is a drilling fluid expansion surface, and an inner lower part of the upper drill rig connection joint is a central drill bit stabilizing surface.

Furthermore, a top end of the annular drill bit is a drill bit body welding groove corresponding to the joint welding groove, an outer upper part of the annular drill bit body is a drill bit outer surface, and the drill bit crown is an annular surface that is disposed at an outer lower part of the annular drill bit body and has a diameter equal to a diameter of the cylindrical surface of the upper drill rig connection joint. The drill bit crown further includes a drilling drill bit steel body, an annular drill bit blade wing and annular drill bit cutting teeth, the annular drill bit cutting teeth are mounted at the top of the drill bit blade wing, and the rock pillar through hole is disposed at a middle part of the annular drill bit steel body and penetrated through an inner cavity of the annular drill bit steel body. An inner upper part of the annular drill bit is a central drill bit stabilizing transfer surface having the same structure as the central drill bit stabilizing surface. An inner middle part of the annular drill bit is a converging annular surface, a nozzle runner is disposed between the converging annular surface and the annular drill bit blade wing, and a nozzle is mounted at the top of the nozzle runner.

Further, the ordinary drilling fluid runner is disposed around the central drill bit drilling fluid runner, and the top end of the central drill bit is a drilling fluid division surface dividing the drilling fluid into two parts. One part of the drilling fluid flows into the central drill bit via the central drill bit drilling fluid runner, and the other part flows into the nozzle runner of the annular drill bit via the ordinary drilling fluid runner. An outer side of the central drill bit body is a stabilizing receiving surface cooperating with the stabilizing transfer surface of the central drill bit. The central drill bit rock-breaking body is disposed at a central position of the bottom end of the central drill bit, efficient rock-breaking teeth are disposed on the central drill bit rock-breaking body, and the rock debris transfer channel is disposed at an upper part of the efficient rock-breaking teeth.

Further, the efficient rock-breaking teeth are of axe-shaped structure. A bottom end of the efficient rock-breaking teeth is a press-in cylindrical surface, and both sides of the efficient rock-breaking teeth are side wing conformal surfaces.

A drilling method using the drill bit with joint function of induced unloading and abrasive jet includes the following steps.

At step 1), the annular drill bit touches the bottom-hole to break rock under the actions of a drilling pressure and a torque.

At step 2), along with the progress of rock breaking, an annular borehole is obtained by breaking at the bottom hole.

At step 3), the central drill bit touches a rock pillar at an inner side of the annular borehole.

At step 4), the central drill bit breaks the rock pillar at the inner side of the annular borehole, and the drilling fluid enters the rock debris transfer channel via the central drill bit drilling fluid runner to be mixed with the rock debris produced by breaking the rock pillar at the inner side of the annular borehole and delivered into the abrasive generation cavity and then mixed with ordinary-action drilling fluid in the ordinary drilling fluid runner, and then formed into abrasive jet via the nozzle runner and the nozzle. In this way, the entire rock-breaking drilling process is realized.

The present disclosure has the following beneficial effects.

According to the present disclosure, in the drilling bit rock-breaking process where the joint function of induced unloading and abrasive jet is used to improve the drilling rock-breaking efficiency, the annular drill bit touches the bottom hole and breaks rock under the actions of drilling pressure and torque to form an annular-groove bottom hole and form a rock pillar at the central position. With growth of the rock pillar, the central drill bit touches the rock pillar and starts to break the rock pillar under the actions of drilling pressure and torque, thereby realizing the entire rock-breaking drilling process. Further, the present disclosure has the following advantages.

1) The double effects of inducedly unloading the bottom hole stress and improving the rock-breaking efficiency with the aid of the abrasive jet can be realized with a unique speed-up idea.

2) In addition to generating abrasive jet, the generated abrasive may also increase a nozzle discharge of the annular drill bit, thereby further improving the rock-breaking efficiency of the annular drill bit.

3) The drill bit of the present disclosure is simple in principle and structure without mounting other tools and affecting implementation of other drilling procedures.

4) With its wide application scope, the drill bit of the present disclosure can be applied to different well types such as a vertical well and a directional well, and may be directly connected to a drill collar, and used in cooperation with tools such as a power drill rig and a pulse jet generator.

5) Operations in the drilling process are exactly same as those of conventional drilling. Therefore, there are no special requirements for ground facilities, drilling strings and bit types, thereby facilitating promotion and application.

Figure 1:
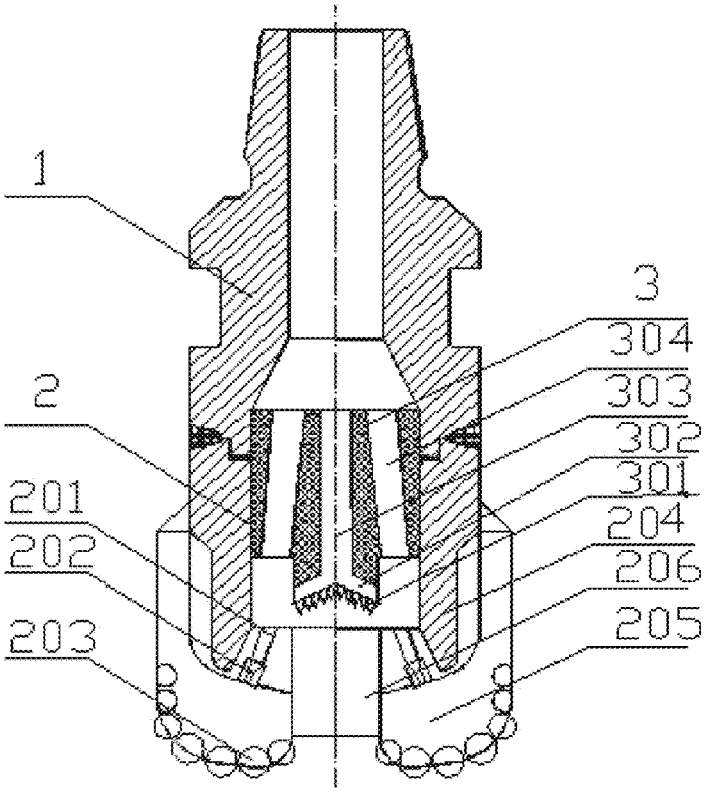
FIG. 1 is a schematic diagram illustrating an overall structure of a drill bit for improving a drilling rock-breaking efficiency using joint function of induced unloading and abrasive jet according to an example of the present disclosure.
Figure 2:
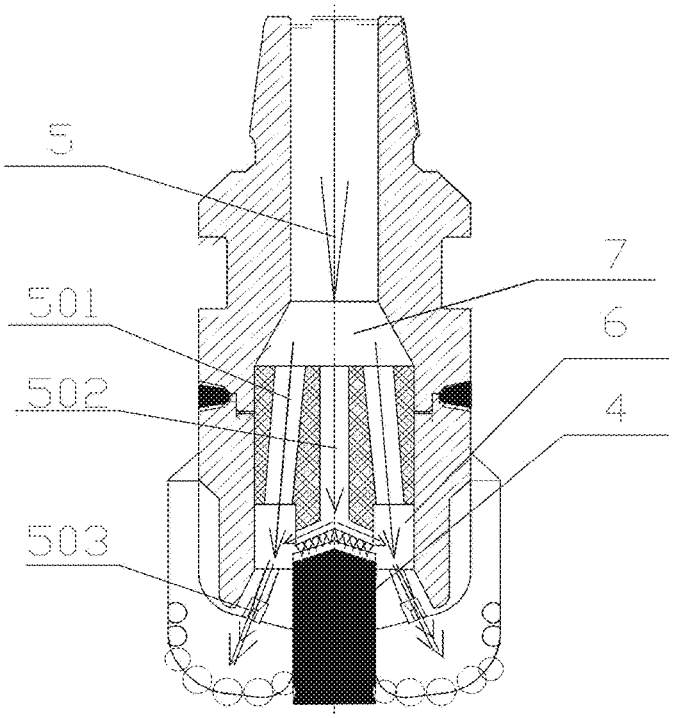
FIG. 2 is a schematic diagram illustrating a drilling fluid runner and a rock-breaking process of a drill bit for improving a rock breaking efficiency with joint function of induced unloading and abrasive jet according to an example of the present disclosure.

Numerals of the drawings are described as follows: 1. upper drill rig connection joint; 2. annular drill bit body; 3. central drill bit; 4. rock pillar; 5. well-entering drilling fluid; 6. abrasive generation cavity; 7. drilling fluid main cavity; 201. nozzle runner; 202. nozzle; 203. cutting teeth; 204. annular drill bit steel body; 205. annular drill bit blade wing; 206. rock pillar through hole; 301. efficient rock-breaking teeth; 302. rock debris transfer channel; 303. central drill bit drilling fluid runner; 304. ordinary drilling fluid runner; 501. ordinary-action drilling fluid; 502. central drill bit flowing-through drilling fluid; 503. drilling fluid abrasive jet; 301-1. press-in cylindrical surface; 301-2. side wing conformal surface; 901. drilling fluid flow-expansion surface; 902. stabilizing receiving surface; 903. stabilizing transfer surface; 904. outer drilling fluid runner; 906. cavity of annular drill bit 907. abrasive generation cavity.

DETAILED DESCRIPTION OF THE EMBODIMENTS

To make the objects, technical solutions and advantages of the present disclosure clearer, the present disclosure will be further described in detail below in combination with examples. It is to be understood that the specific examples described herein are only used to explain the present disclosure rather than limit the present disclosure. That is, the described examples are merely part of examples of the present disclosure rather than all examples.

As shown in FIGS. 1-5, a drill bit with joint function of induced unloading and abrasive jet includes an annular drill bit and a central drill bit 3. The central drill bit 3 is mounted in the center of the annular drill bit and recessed into a cavity of the annular drill bit, and the central drill bit 3 and the annular drill bit cannot rotate relative to each other. The annular drill bit includes an upper drill rig connection joint 1 and an annular drill bit body 2, a nozzle runner 201, a nozzle 202 and a rock pillar through hole 206 are disposed at a drill bit crown of the annular drill bit body, and a central drill bit rock-breaking body of the central drill bit 3 corresponds to the rock pillar through hole. An ordinary drilling fluid runner 304 and a central drill bit drilling fluid runner 303 are disposed in the central drill bit body respectively, a rock debris transfer channel 302 is disposed at an inner bottom end of the central drill bit 3 and in communication with the central drill bit drilling fluid runner 303, an abrasive generation cavity 6 is disposed at an outlet of the rock debris transfer channel 302 which is at a lower part of the ordinary drilling fluid runner 304, and the abrasive generation cavity is in communication with the nozzle runner 201 and the nozzle 202.

An outer upper part of the upper drill rig connection joint 1 is a drill rig connection buckle for connecting an underground drill rig; an outer middle part of the upper drill rig connection joint 1 is a joint outer surface which is a cylindrical surface, a middle part of the drill bit outer surface is a drill bit upper clamping surface for applying a torque to the drill bit during the mounting process of drill bit; a bottom end of the upper drill rig connection joint 1 is a joint welding groove for being welded with an upper part of the annular drill bit body 2; an inner upper part of the upper drill rig connection joint 1 is a drilling fluid runner for the drilling fluid to enter the drill bit; an inner middle part of the upper drill rig connection joint 1 is a drilling fluid flow-expansion surface for stably expanding an area of the drilling fluid runner; an inner lower part of the upper drill rig connection joint 1 is a stabilizing surface of the central drill bit 3 for stabilizing the central drill bit.

A top end of the annular drill bit body 2 is a drill bit body welding groove for being welded with the joint welding groove; an outer upper part of the annular drill bit body 2 is a drill bit outer surface having a diameter equal to that of the joint outer surface of the upper drill rig connection joint 1; a lower part of the annular drill bit body 2 is a drill bit crown including an annular drill bit steel body 204, a nozzle runner 201, a nozzle 202, an annular drill bit blade wing 205, a rock pillar through hole 206 and cutting teeth 203; the cutting teeth 203 are mounted at the top end of the annular drill bit blade wing 205; the rock pillar through hole 206 is located at a middle part of the annular drill bit steel body 204 and penetrated to the bottom end through an inner cavity of the annular drill bit steel body 204; an inner upper part of the annular drill bit body 2 is a stabilizing transfer surface of the central drill bit with its shape and size identical with those of the stabilizing surface of the upper drill rig connection joint 1; an inner middle part of the annular drill bit body 2 is a converging annular surface, a nozzle runner 201 is disposed between the converging annular surface and the annular drill bit blade wing 205, and a nozzle 202 is mounted at an end of the nozzle runner 201 close to the annular drill bit blade wing 205.

A top end of the central drill bit 3 is a drilling fluid division section for dividing the drilling fluid entering the drill bit for improving the rock-breaking efficiency with the joint function of induced unloading and abrasive jet into two parts. One part of the drilling fluid flows into the central drill bit via the central drill bit drilling fluid runner 303, and the other part flows into the nozzle runner 201 of the annular drill bit via the ordinary drilling fluid runner 304; an outer side of the central drill bit 3 is a stabilizing receiving surface for stabilizing the central drill bit 3 and transmitting the rock-breaking torque to the central drill bit 3 in cooperating with the stabilizing transfer surface of the central drill bit at the inner upper part of the annular drill bit body 2; a bottom end of the central drill bit 3 is a central drill bit rock-breaking body, a lower end of the central drill bit rock-breaking body is mounted with efficient rock-breaking teeth 301, and the rock debris transfer channel 302 is disposed at an upper part of the efficient rock breaking teeth and in communication with the central drill bit drilling fluid runner 303 to direct the drilling fluid of the central drill bit drilling fluid runner 303 to the inner cavity of the annular drill bit body 2 and carry away rock debris produced by the rock breaking of the efficient rock-breaking teeth 301 at the same time.

Figure 3:
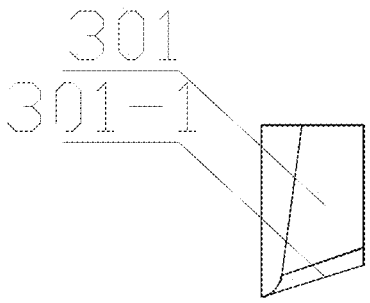
FIG. 3 is a front view of efficient rock-breaking teeth according to an example of the present disclosure.
Figure 4:
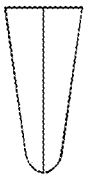
FIG. 4 is a left view of efficient rock-breaking teeth according to an example of the present disclosure.
Figure 5:
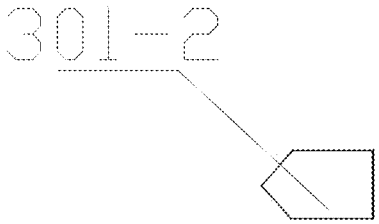
FIG. 5 is a top view of efficient rock-breaking teeth according to an example of the present disclosure.
Figure 6:
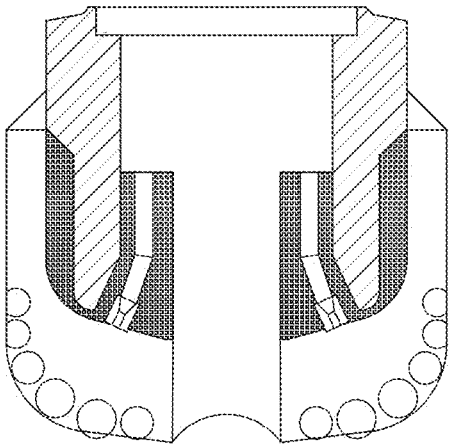
FIG. 6 is a schematic diagram illustrating a drill bit crown of a drill bit according to an example of the present disclosure.
Figure 7:
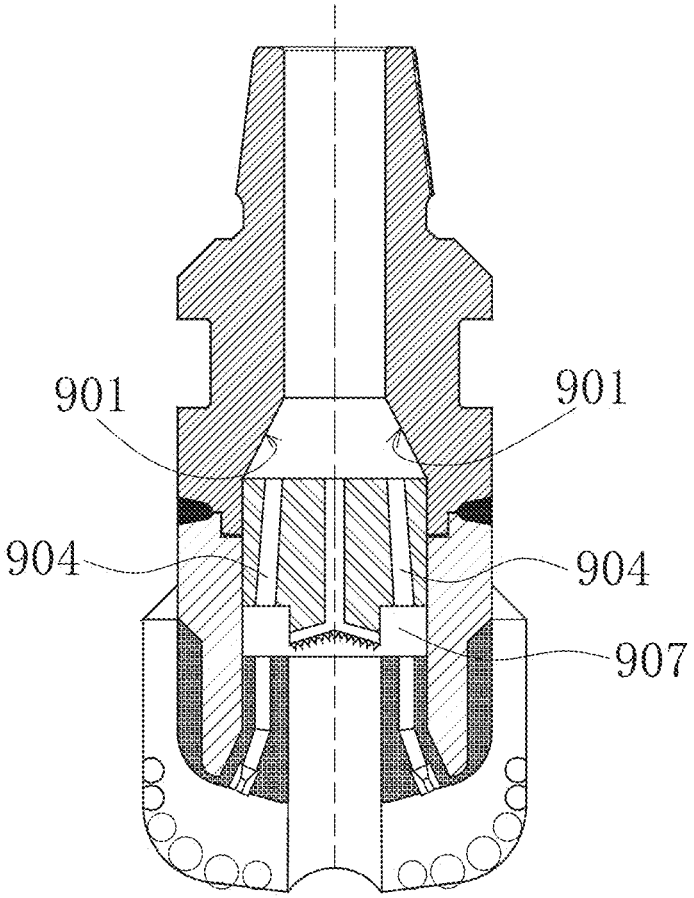
FIG. 7 is a schematic diagram illustrating a drilling fluid flow-expansion surface, an outer drilling fluid runner, and an abrasive generation cavity of a drill bit according to an example of the present disclosure.
Figure 8:
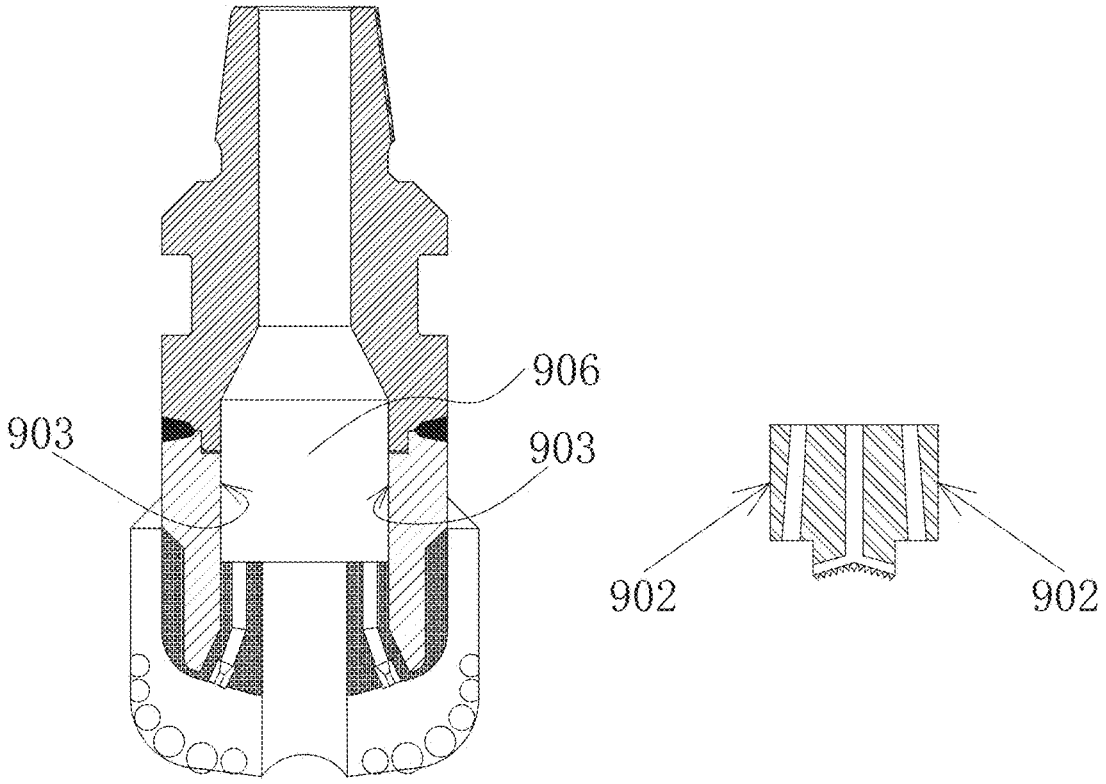
FIG. 8 is schematic diagram illustrating a stabilizing receiving surface, a stabilizing transfer surface, and a cavity of an annular drill bit of a drill bit according to an example of the present disclosure.

As shown in the left side of FIG. 3, the front end of the efficient rock-breaking teeth 301 is of an axe-shaped structure for breaking the rock of the bottom hole; the bottom end of the efficient rock-breaking teeth 301 is a press-in cylindrical surface 301-1 for pressing the high efficiency rock-breaking teeth 301 into the rock when the drilling pressure is applied; both sides of the efficient rock-breaking teeth 301 are side wing conformal surfaces 301-2 for maintaining an efficient rock-breaking structure even if the efficient rock breaking teeth 301 are worn.

A flowing path of the drilling fluid in the drill bit for improving the rock breaking efficiency with the joint function of induced unloading and abrasive jet is as follows: the well-entering drilling fluid 5 enters the drill bit and is divided into central drill bit flowing-through drilling fluid 502 and ordinary-action drilling fluid 501 by a drilling fluid main cavity 7 and a drilling fluid division section at the top end of the central drill bit 3; the central drill bit flowing-through drilling fluid 502 flows to the bottom of the central drill bit to be diverted to the rock debris transfer channel of the central drill bit, and then flows into the inner cavity of the annular drill bit body 2 along with rock debris to converge with the ordinary-action drilling fluid 501 so as to form a drilling fluid abrasive jet 503 which is sprayed into the bottom hole via the nozzle runner 201 and the nozzle 202.

In the rock breaking process of the drill bit for improving the drilling rock-breaking efficiency with the joint function of induced unloading and abrasive jet, the annular drill bit touches the bottom hole to break rock under the actions of drilling pressure and torque so as to form the annular groove bottom hole and form a rock pillar 4 at the central position. With the growth of the rock pillar 4, the central drill bit touches the rock pillar 4 and starts to break the rock pillar under the actions of drilling pressure and torque, thereby realizing an entire drilling rock-breaking process.

A drilling method using the drill bit with joint function of induced unloading and abrasive jet includes the following steps.

At step 1), the annular drill bit touches the bottom hole to break rock under actions of a drilling pressure and a torque.

At step 2), with the progress of rock breaking, an annular borehole is obtained by breaking at the bottom hole.

At step 3), the central drill bit touches a rock pillar at an inner side of the annular borehole.

At step 4), the central drill bit breaks the rock pillar at the inner side of the annular borehole, and the drilling fluid enters the rock debris transfer channel via the central drill bit drilling runner to be mixed with the rock debris produced by breaking the rock pillar at the inner side of the annular borehole and then delivered into the abrasive generation cavity and then mixed with the ordinary-action drilling fluid in the ordinary drilling fluid runner to form the abrasive jet via the nozzle runner and the nozzle. In this way, the entire rock-breaking drilling process is realized.

The method divides the drilling rock-breaking process into two parts: an annular borehole is firstly obtained by breaking, and then, the rock pillar at the inner side of the annular borehole is broken so as to effectively inducedly unload the bottom hole stress, and the rock debris produced by breaking the rock pillar at the inner side of the annular borehole is delivered as abrasive into the drilling fluid of the drill bit and then into the abrasive generation cavity 6 so as to form the abrasive jet. In this way, the purpose of improving the drilling rock-breaking efficiency with the joint function of induced unloading and abrasive jet is achieved.

Of course, the foregoing descriptions are not intended to limit the present disclosure, and the present disclosure is also not limited to the above examples. Changes, modifications, additions or substitutions made by persons skilled in the art within the scope of essence of the present disclosure shall also be encompassed in the scope of protection of the present disclosure.

The invention claimed is:

1. A drill bit with joint function of induced unloading and abrasive jet, comprising an annular drill bit and a central drill bit, wherein the central drill bit is mounted in the center of the annular drill bit and recessed into a cavity of the annular drill bit, the central drill bit and the annular drill bit are incapable of rotating relative to each other, the annular drill bit comprises an upper drill rig connection joint and an annular drill bit body, a nozzle runner, a nozzle and a rock pillar through hole are disposed at a drill bit crown of the annular drill bit body, a central drill bit rock-breaking body of the central drill bit corresponds to the rock pillar through hole, an outer drilling fluid runner and a central drill bit drilling fluid runner are disposed inside the central drill bit respectively, a rock debris transfer channel is disposed at an inner bottom end of the central drill bit and in communication with the central drill bit drilling fluid runner, an abrasive generation cavity is disposed at an outlet of the rock debris transfer channel which is at a lower part of the outer drilling fluid runner, and the abrasive generation cavity is in communication with the nozzle runner and the nozzle;

the outer drilling fluid runner is disposed around the central drill bit drilling fluid runner, a top end of the central drill bit is a drilling fluid flow-expansion surface dividing the drilling fluid into two parts, one part of the drilling fluid flows into the central drill bit via the central drill bit drilling fluid runner, the other part flows into the nozzle runner of the annular drill bit via the outer drilling fluid runner, an outer side of the central drill bit body is a stabilizing receiving surface cooperating with a stabilizing transfer surface of the annular drill bit, the central drill bit rock-breaking body is disposed at a central position of a bottom end of the central drill bit, rock-breaking teeth are disposed on the central drill bit rock-breaking body, and the rock debris transfer channel is disposed at an upper part of the rock-breaking teeth.

* * * * *